US006048492A

United States Patent [19]

Shersher

[11] Patent Number: 6,048,492

[45] Date of Patent: Apr. 11, 2000

[54] PLATINUM ALLOY COMPOSITION

[75] Inventor: Igor Shersher, Princeton Junction, N.J.

[73] Assignee: Alexander Primak Jewelry, Inc., New York, N.Y.

[21] Appl. No.: 09/044,288

[22] Filed: Mar. 19, 1998

[51] Int. Cl.[7] ..... C22C 5/04

[52] U.S. Cl. ..... 420/466

[58] Field of Search ..... 420/466

[56] References Cited

U.S. PATENT DOCUMENTS 2,279,763 4/1942 Sivil ..... 420/466

3,305,816 2/1967 Doi ..... 420/466

4,806,306 2/1989 Groll et al. ..... 420/466

*Primary Examiner*—Deborah Yee

*Attorney, Agent, or Firm*—Gottlieb, Rackman & Reisman, P.C.

[57] ABSTRACT

An improved platinum alloy composition is provided. The platinum alloy composition comprises platinum in an amount of about 58.5 weight percent, palladium as a filler metal in an amount between about 26.5 and 36.5 weight percent, and at least one of iridium, cobalt and ruthenium in an amount between about 5 and 15 weight percent.

1 Claim, No Drawings

PLATINUM ALLOY COMPOSITION

BACKGROUND OF THE INVENTION

This invention relates to a platinum alloy composition, and more particularly, to a platinum alloy composition for use in jewelry products.

As is well known, gold jewelry is available in 18 carat to 24 carat products (expensive) and 10 carat to 14 carat products for less affluent consumers, as well as gold-plated products for those who cannot afford gold jewelry but still want the look of gold.

In surprising contrast, platinum jewelry has only been available using platinum of 85% to 95% platinum content. Thus, even the smallest platinum jewelry items sell for two to three times more than the equivalent 14 carat gold jewelry. As a result, platinum jewelry has never been a big seller, and jewelry merchandisers and retailers repeatedly report sales that fall short of expectations.

Accordingly, it would be desirable to provide a platinum alloy composition suitable for jewelry that is less expensive than the platinum that is presently available, yet still provides a platinum jewelry item with a look that is desirable.

SUMMARY OF THE INVENTION

Generally speaking, in accordance with the invention, there is provided an improved platinum alloy composition. The platinum alloy composition comprises platinum in an amount of about 58.5 weight percent, palladium as a filler metal in an amount between about 26.5 and 36.5 weight percent, and at least one of iridium, cobalt and ruthenium in an amount between about 5 and 15 weight percent.

The platinum alloy composition of the invention appears and looks no different than 95 percent platinum, but is substantially lighter, less dense, and thus, less expensive to produce.

Accordingly, it is an object of the invention to provide an improved platinum alloy composition.

Still another object of the invention is to provide an improved platinum alloy composition that is suitable for use in jewelry for the mass commercial market.

A further object of the invention is to provide an improved platinum alloy composition which is substantially lighter and less dense than conventional platinum alloy compositions.

Still other objects and advantages of the invention will in part be obvious, and will in part be apparent from the following description.

The invention accordingly comprises the features or construction as described in the following description, and the scope of the invention will be indicated in the claims.

DETAILED DESCRIPTION OF THE PREFERRED EMBODIMENT

The platinum alloy composition of the invention include platinum in an amount of about 58.5 weight percent. This weight percent is equivalent to 14 carat on a 24 carat scale.

The inventive composition further includes palladium as a filler metal in an amount between about 26.5 and 36.5 weight percent. The purpose of the filler metal is to enhance the practical qualities of the alloy and to reduce overall cost. Palladium was chosen because its behavior and chemical properties are closest to that of platinum.

In order to improve hardness, the inventive alloy composition also includes at least one of the metals cobalt, ruthenium and iridium in an amount between about 5 and 15 weight percent. The preferred metal hardener is iridium in the amount of 5–10 weight percent, since it offers gradual hardness improvements over a wide range of concentrations, with no deterioration of alloy properties.

In order to demonstrate the improved characteristics of the inventive platinum alloy composition, the composition underwent a number of comparative tests as compared to other, substantially more pure platinum alloy compositions.

| | Tensile (PSI) | Elongation (%) | Hardness (vickers) | Melting/Casting Temperature (C.) |
|---|---|---|---|---|
| Pure Platinum | 20,000 annealed | NA | 40 annealed | 1769/2100 |
| 950 Pt. 5% Ru | 46,200 | 59.0 | 126 | 1795/2000 |
| Inventive Composition | NA | Excellent Reduction | 90–120 | 1700/1900 |
| 900 Pt 10% Ir | 18,900 | 8.2 | 138.4 | 1800/2150 |
| 950 Pt 5% Co | 59,400 | 83.0 | 227 | 1765/2120 |

In order to prepare the platinum alloy composition of the invention, a high temperature melting process must be carried out. This is achieved using induction melting equipment, as is well known in the art. At all times, extreme care must be exercised in order to limit metal contamination, as platinum and palladium are easily contaminated by many elements routinely present in the environment. Such care is achieved by melting the metals in either a vacuum or an inert gas atmosphere, by preventing contact with other metals, and by preventing mixing with silica-based products.

Initially, the three metal components of the inventive composition are melted in a silica (for small, fast melts—?) or a zirconium oxide (for large, slow melts) crucible. Because a vacuum or inert gas must be used, all three metals are placed in the crucible at the same time. Significantly, the molten metals must be "turned" (utilizing medium to low frequency induction fields) in order to obtain an appropriate mixing of the metals.

Following the melting step, the resulting button-nugget elements are rolled and annealed in three to five stages in order to reduce diameter and improve mechanical qualities of the mix. Thereafter, the mixed metal composition is re-melted as before, and a shot or plate is made. The alloy metal composition is now ready for production use for making jewelry or any other metal products which require the use of platinum.

Please note that the inventive metal alloy composition may be soldered using a 1,300/1,500 platinum solder. Welding, however, should be performed with a platinum wire, as is done with respect to most other platinum alloys.

It will thus be seen that the objects set forth above, among those made apparent from the preceding description, are efficiently attained, and since certain changes may be made in the inventive product without departing from the scope thereof, it is contemplated that all matter contained in the above description shall be interpreted as illustrative and not in a limiting sense.

It is further understood that the following claims are intended to cover all of the features of the invention therein described, and all statements of the scope of the invention which, as a matter of language, might be said to fall therebetween.

what is claimed:

1. A jewelry product containing a platinum alloy composition, the platinum composition consisting eventually of pure platinum in an amount of about 58.5 weight percent; palladium in an amount between about 26.5 and 36.5 weight percent; and a metal selected from the group consisting of iridium, cobalt and ruthenium in an amount between about 5 and 15 weight percent.

* * * * *